US010882089B2

(12) United States Patent
Broeks et al.

(10) Patent No.: US 10,882,089 B2
(45) Date of Patent: Jan. 5, 2021

(54) ROLLING MILL FOR METAL STRIP

(71) Applicant: FIVES DMS, Noyelles-les-Seclin (FR)

(72) Inventors: Benoît Broeks, Hellemmes (FR); Aymeric Delanoy, Carvin (FR)

(73) Assignee: FIVES DMS

( * ) Notice: Subject to any disclaimer, the term of this patent is extended or adjusted under 35 U.S.C. 154(b) by 217 days.

(21) Appl. No.: 16/084,990

(22) PCT Filed: Mar. 17, 2017

(86) PCT No.: PCT/FR2017/050620

§ 371 (c)(1),
(2) Date: Sep. 14, 2018

(87) PCT Pub. No.: WO2017/158306

PCT Pub. Date: Sep. 21, 2017

(65) Prior Publication Data

US 2019/0022722 A1 Jan. 24, 2019

(30) Foreign Application Priority Data

Mar. 17, 2016 (FR) ..... 16 52265

(51) Int. Cl.
*B21B 13/02* (2006.01)
*B21B 31/10* (2006.01)

(52) U.S. Cl.
CPC ..... *B21B 13/02* (2013.01); *B21B 31/106* (2013.01); *B21B 2013/025* (2013.01)

(58) Field of Classification Search
CPC ..... B21B 13/00; B21B 13/02; B21B 13/025; B21B 31/02; B21B 31/06; B21B 31/08; B21B 31/10; B21B 31/106; B21B 31/12
See application file for complete search history.

(56) References Cited

U.S. PATENT DOCUMENTS 3,446,050 A * 5/1969 O'Brien ..... B21B 31/10 72/239
3,699,796 A 10/1972 Eibe et al.
(Continued)

FOREIGN PATENT DOCUMENTS

DE 21 59 113 A1 5/1972
EP 0 738 546 A1 10/1996

OTHER PUBLICATIONS

International Search Report, dated Jun. 6, 2017, from corresponding PCT/FR2017/0560620 application.

*Primary Examiner* — Edward T Tolan
(74) *Attorney, Agent, or Firm* — Nixon & Vanderhye

(57) ABSTRACT

Disclosed is a rolling mill for a metal strip, including: a holding cage; an assembly of superimposed rolls with substantially parallel axes, including lower and upper working rolls, defining the gap for passage therethrough, and two respectively lower and upper supporting rolls respectively applied to the working rolls on the opposite side to that of the gap, each roll having two rotatably mounted ends, each on a bearing carried by a chock; and a system for clamping the chocks of the working rolls along the axis of the roll, while allowing the chocks to slide along a guide, following the clamping plane including a mechanical unit using the closing movements of the holding cage in order to switch from a retracted position, allowing the withdrawal, along the axis thereof, of the working rolls out of the holding cage, into a locking position, ensuring locking of the chocks.

20 Claims, 4 Drawing Sheets

(56) References Cited

U.S. PATENT DOCUMENTS

| | | | | |
|---|---|---|---|---|
| 3,861,189 | A | 1/1975 | Lindermann | |
| 4,167,107 | A * | 9/1979 | Simmonds | B21B 31/10 72/239 |
| 6,408,667 | B1 * | 6/2002 | de Jesus, Jr. | B21B 31/103 29/401.1 |
| 6,763,565 | B2 * | 7/2004 | Mukaigawa | B21B 31/103 29/426.1 |
| 7,302,820 | B2 * | 12/2007 | Le Viavant | B21B 13/001 72/237 |

* cited by examiner

ROLLING MILL FOR METAL STRIP

BACKGROUND OF THE INVENTION

Field of the Invention

The invention relates to a rolling mill comprising an improved system for clamping working rolls.

The field of the invention is that of Quarto cage rolling mills that have a particular application, for example, in annealing lines, or even in galvanization lines, or even in reversible or irreversible off-line rolling mills, for a metal strip. The rolling mill according to the invention has a particular application, particularly after annealing the strip, for performing a skin-pass, often in order to remove the elastic zone from the metal strip to impress roughness thereon and/or to improve shine and/or to improve flatness.

A Quarto cage rolling mill has a holding cage comprising two pairs of uprights at the two ends of the cage, between which four rolls with parallel axes are provided, namely two lower and upper working rolls, defining the through-gap for the strip to be rolled, as well as two upper and lower supporting rolls, respectively coming into abutment on the working rolls, on the side opposite that of the through-gap. The motorization for the rolls is provided on one side of the cage, the other side, called operator side, being the side where the maintenance operations are performed, in particular the operations for changing rolls through the access window provided between the two uprights of the cage on this operator side.

In such rolling mills, each supporting or working roll is rotatably mounted at its ends on chocks, by means of bearings, for example, roller bearings or even hydrostatic bearings. These chocks are supports that can be moved in a direction parallel to the clamping plane, between the two uprights of the cage.

A rolling mill of the Quarto type comprises means for applying a clamping force between the chocks of the supporting rolls, in the form of two hydraulic jacks, often at the lower end of the cage, respectively coming into abutment on the two chocks of one of the supporting rolls, often the lower roll. When retracted, these two hydraulic jacks allow the cage to be opened, namely they allow the separation of the upper rolls (upper supporting and working rolls) in relation to the lower rolls (lower supporting and working rolls) and in a position where said rolls can be extracted from the cage.

The chocks of the working rolls and the chocks of the supporting rolls are thus mounted to slide in a direction parallel to the clamping plane, so as to allow the opening or even closing of the cage or even to facilitate the maintenance and disassembly operations.

To this end, each chock typically comprises two parallel and opposite slide plates, on either side of the axis of rotation of the roll and cooperating with slide plates rigidly connected to uprights and parallel thereto, in the vicinity of the two lateral sides of the window. These slide plates nevertheless do not provide locking of the chocks (and of their roll) along the axis of the supported roll.

In the field of rolling mills, this locking of the chocks of the roll along the axis of the roll is called "clamping" of the chocks. In a Quarto cage rolling mill, the system for clamping chocks of the working rolls comprises, for each chock, two opposite vertical grooves for the chocks located either side of the axis of rotation of the roll, as well as two associated, horizontally movable, locking components, respectively rigidly connected to the uprights. Each locking roll can transit from a locking position, in which the locking component enters the vertical groove, to an unlocked position, in which the locking component is retracted out of this groove.

In the locking position, the locking component, rigidly connected to the upright, prevents movement of the chock along the axis of the roll, whilst allowing the chock to slide along the vertical axis of the uprights, through movement of the locking component along the vertical groove of the chock.

In order to allow the replacement of the working rolls, the rolling mill needs to be opened, through retraction of the clamping jacks, and the clamping system needs to be unlocked. It is only after these two actions are performed that the rolls and their chocks can be extracted from the cage of the rolling mill.

According to the observations of the inventor, the system for clamping working rolls of the prior art comprises actuators that are dedicated to this function, typically hydraulic jacks, as well as electric contact limit stops, in order to transit the locking component from its retracted position to its locking position, and vice versa.

According to the observations of the inventor, such actuators increase the cost of the rolling mill, the presence of flexible hoses and/or rigid pipework that are required for the operation of these hydraulic jacks also represents a potential cause of oil leaks.

However, a rolling mill of the Quarto type is known from document U.S. Pat. No. 3,861,189 that uses the approaching movement of the lower rolls in relation to the upper rolls when closing the holding cage to cause the clamping of the chocks of the working rolls.

According to this prior art:

- the axial stop of the chock of the lower working roll is provided by means of two supporting arms ("supporting arms" 14), horizontally and rigidly extending from the two sides of the chock, in a symmetrical manner in relation to the axis of the roll, which come into abutment against the walls of two locking grooves ("locking groove" 19) located in grooves ("passage grooves" 12) of the two guiding blocks rigidly connected to the uprights of the cage when the roll is in the upper position, which corresponds to the working position (cf. FIG. 1): the clamping of the lower working roll is thus obtained;
- the axial stop of the chock of the upper working roll is provided by means of two locking pockets ("locking pockets" 18) of the chock referenced 5, which enclose two corresponding locking cams ("locking cams" 17) of the chock of the lower working roll 4.

According to the observations of the Applicant, the axial forces absorbed by the chock of the upper working roll are fully taken-up by the chock of the lower working roll before being absorbed by the frame by means of the guiding blocks, which is not ideal in terms of the take-up of mechanical forces.

The device according to document EP 0738546 A1 provides locking of the chocks of the working rolls by means of two supporting parts, reference numerals 6, 6', symmetrically disposed on the two sides of the frame of the rolling mill and rigidly connected thereto.

The axial stop of the chock of the upper working roll is provided by a retention part, reference numeral **60*b*, of the supporting part, reference numeral 6, rigidly connected to the frame of the rolling mill, which is housed in a recess, reference numeral 41, of the chock of the upper working roll, reference numeral 4, one of the walls of which comes into abutment against the retention part 60*b***.

The axial stop of the chock of the lower working roll is provided by means of the pads, reference numerals 70, 71, which extend from the respective upper or lower surfaces of the chocks and are housed in corresponding holes of the other chock, reference numeral 46, 46', thus preventing the axial movement of one chock in relation to the other.

However, as specified in the description (cf. page 9, lines 45-51), the pads (70, 71) only extend over a distance "substantially equal to half the maximum separation", which corresponds to the maximum separation in the working position (cf. page 5, lines 26-34). Thus, in certain working situations, when the rolls are separated by a distance that is greater than half the maximum separation, the pads no longer enter the holes of the opposite chock and the axial stop of the lower chock (4') is no longer provided by the previously described system.

According to the observations of the Applicant, document EP 0738546 A1 has the following features:

- the previously described system only provides axial locking of the chocks of the upper working roll and of the chocks of the lower working roll for some openings of the cage (during operation);
- in the same way as in document U.S. Pat. No. 3,861,189, and for the small openings of the cage (during operation), the axial stop of the chock of one of the two working rolls (the lower roll in the case of document EP 0738546 A1) is only provided by means of the chock of the other working roll (the upper roll in the case of document EP 738546 A1), which is not ideal in terms of the take-up of mechanical forces.

The aim of the present invention is to overcome the aforementioned disadvantages by proposing a rolling mill having an improved system for clamping working rolls.

More specifically, the aim of the present invention is to propose a rolling mill for a metal strip providing clamping of the lower and upper working rolls without the use of a dedicated actuator, while providing better take-up of the axial forces, and compared to the aforementioned prior art made up of document U.S. Pat. No. 3,861,189 (or document EP 0738546 A1).

Other aims and advantages of the present invention will become apparent throughout the description, which is provided solely by way of a non-limiting example.

Furthermore, the invention relates to a rolling mill for a metal strip comprising:

- a holding cage;
- an assembly of superimposed rolls with substantially parallel axes comprising two lower and upper working rolls, defining the through-gap, and two respectively lower and upper supporting rolls, intended to respectively come into abutment on the working rolls on the side opposite that of the through-gap;
- each roll having two rotatable mounted ends, each one on a bearing borne by a chock;
- guiding means between the chocks of the rolls and the holding cage, along the clamping plane;
- means for applying a clamping force between the chocks of the supporting rolls, comprising hydraulic jacks;
- a system for clamping chocks of the working rolls, ensuring the locking of the chocks in relation to the holding cage, along the axis of the roll, while allowing the chocks to slide along the guiding means, along the clamping plane.

According to the invention, the system for clamping working rolls comprises mechanical means that can transit from a first retracted position, allowing withdrawal, along the axis thereof, of the working rolls out of the holding cage, to a second locking position ensuring the locking of the chocks in relation to the holding cage, along the axis of the roll, said mechanical means using:

- the approaching movement of the lower rolls in relation to the upper rolls when closing the holding cage in order to cause the transition from the first retracted position to the second locking position; and
- the separating movement of the lower rolls in relation to the upper rolls during the opening of the holding cage in order to cause the transition from the second locking position to the first retracted position.

Advantageously, the clamping and unclamping operations use the same actuators required for opening and closing the holding cage, namely the hydraulic jacks of said means for applying a clamping force between the chocks of the supporting rolls. In other words, these clamping operations do not require actuators that are dedicated to these operations nor even dedicated electric contact limit stops.

Furthermore, and still according to the invention, said mechanical means comprise at least one movable component sliding along an upright of the holding cage under the action of the opening and closing movements of the holding cage, said movable component extending lengthwise, along an upright of the holding cage received in a deep groove of the inner wall of an upright, comprising a locking end, which, in said second locking position of the mechanical means, simultaneously enters a vertical groove of one of the chocks of a working roll and the vertical groove rigidly connected to the upright of the holding cage to enable locking of the chocks in relation to the holding cage and which, in the first retracted position, is retracted to slide out of the groove of the chock enabling withdrawal of the working roll out of the holding cage.

Notably, the locking end is, in the second locking position, simultaneously received in these two opposite grooves (vertical and respectively belonging to the chock and to the upright), thus locking the chock in relation to the holding cage, along the axis of the working roll.

Thus, the transmission of the axial forces is provided from the locked chock to the corresponding upright, by means of this locking end simultaneously received in the two opposite grooves, and advantageously without these forces passing through the movable component to the element driving the movable component downwards or upwards.

For example, and according to the examples shown, the locking end (upper) of the movable component is provided to enable the clamping of a chock of the upper working roll, whereas the movable component is coupled by its lower end to the corresponding chock of the other working roll (i.e. namely the lower roll) and so as to allow upwards or downwards driving of the movable component during closing and opening movements of the cage.

Advantageously, the axial forces for locking the chock of the upper working roll are transferred to the uprights of the holding cage, directly by means of the locking end, and without these forces being transferred to the chocks of the working roll cooperating with the other longitudinal end of the movable component, a person skilled in the art would all the more understand that the transmission of the axial forces occurs directly from the chock of the upper working roll to the holding cage by means of the locking end in that the part for coupling to the other longitudinal end of the movable component does not allow any transmission of force in this direction; indeed, this is provided to slide along a horizontal groove parallel to the longitudinal axis of the rolls (and thus parallel to the axial forces), and so as to allow the withdrawal of the lower working roll, by decoupling the lower end of the movable component and of the chock, with the movable component then remaining in the holding cage.

According to optional features of the invention, taken individually or in combination:

said at least one movable component is a distinct element of the chocks of the working rolls, held in the vertical groove rigidly connected to the upright of the holding cage when the working rolls and their chocks are extracted from the holding cage;

the locking end is intended to cooperate with a vertical groove of a chock of an upper or lower working roll, the movable component has, at its other end, a part for coupling to the chock of the working roll located on the other side of the unwinding plane of the metal strip, called lower or upper drive chock, and cooperating with a complementary coupling part of the drive chock and so as to allow the movement of the movable component to be synchronized with the drive chock during opening or closing movements of the holding cage;

in said open position of the holding cage, the drive chocks rest on support rails extending parallel between the uprights at the two ends of the holding cage, transverse to the metal strip, the coupling part of the movable component and the complementary coupling part of the drive chock comprising a groove/rib system respectively belonging to the chock and to the movable component, or vice versa, the coupling part of the movable component being positioned, at the end-of-stroke position, in said open position of the holding cage, in a position in relation to the support rails, so as to allow the coupling/decoupling of the part for coupling the movable component to/from the drive chock during the loading/unloading of the working roll along the support rails.

According to one embodiment, the drive chocks are the chocks of the lower working roll, the movable component being positioned, in said open position of the holding cage, at the lower end-of-stroke position under the effect of gravity in a position in relation to the support rails, so as to allow the coupling/decoupling of the lower end of the movable component to/from the drive chock during the loading/unloading of the working roll along the support rails.

According to another variation, the drive chocks are the chocks of the upper working roll, the movable component being positioned in said open position of the holding cage, under the action of a resilient means, at the upper end-of-stroke position, in a position in relation to the support rails, so as to allow the coupling/decoupling of the upper end of the movable component to/from the drive chock during the loading/unloading of the working roll along the support rails.

According to one embodiment, said mechanical means of the clamping system comprise:

for clamping the chocks of the upper, or alternatively lower, working roll, one or more movable component(s), the locking ends of which enable locking of the chocks of said working roll;

for clamping the chocks of the other lower, or alternatively upper, working roll, projecting parts, rigidly connected to the uprights of the holding cage, and corresponding lateral parts of the chocks, which, in said second locking position of the mechanical means, are overlapping, in the closed position of the holding cage, so as to prevent the axial movement of said working roll, and which, in said first retracted position, are disengaged so as to release the axial movement of the working roll.

According to one embodiment, said rolling mill comprises means for applying vertical bending forces on the working rolls, comprising two assemblies of hydraulic jacks.

According to one embodiment, the hydraulic jacks of the means for applying bending forces are double-acting jacks, each having a fastening end intended to be fitted into a complementary groove of the chock of a working roll.

The rolling mill can further comprise a system, in particular a manual system, for clamping the chocks of the supporting rolls, capable of transitioning from a retracted state, allowing withdrawal of the supporting rolls out of the holding cage, to a locking state, enabling locking of the chocks in relation to the cage, along the axis of the roll, while allowing the chocks to slide along the guiding means, along the clamping plane.

BRIEF DESCRIPTION OF THE DRAWINGS

The invention will be better understood upon reading the following description, which is provided solely by way of an example and is by no means limiting.

Firstly, a Quarto rolling mill 1' will be described as known from the prior art and, more specifically, the systems will be described for clamping the chocks of the working rolls and of the supporting rolls in such a Quarto rolling mill.

Figure 6:
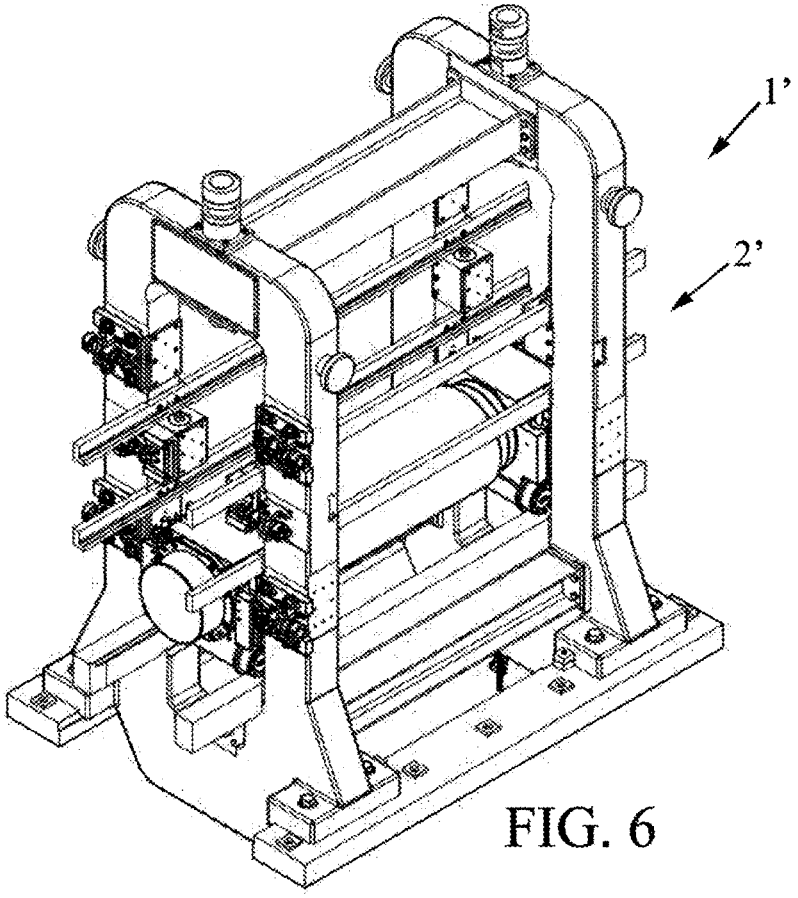
FIG. 6 is a partial view of a Quarto rolling mill according to the prior art provided with a system for clamping rolls with dedicated jacks.

FIG. 6 is a view of such a rolling mill, which shows the holding cage 2' and the lower supporting roll, with the other rolls not being shown. In such a rolling mill, the clamping systems are systems with dedicated hydraulic jacks.

Figure 7:
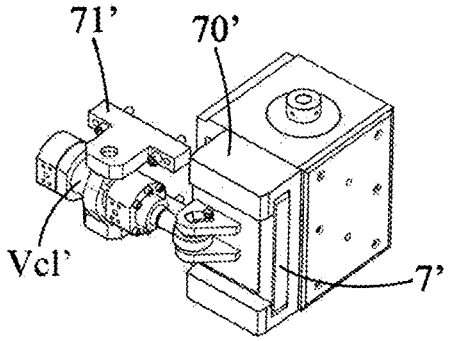
FIG. 7 is a detailed view of a system for clamping with a dedicated jack, as known from the prior art.

FIG. 7 is a partial detailed view of such a clamping system, which comprises a movable component 7' mounted to slide in a direction perpendicular to the upright, under the action of a clamping jack Vc1' and being able to transition from a first retracted position to a second locking position, in which the movable component 7' simultaneously enters two coaxial vertical grooves respectively belonging to the chocks of the lower and upper working rolls (not shown).

DETAILED DESCRIPTION OF THE PREFERRED EMBODIMENTS

The movable component 7' is mounted to slide in a stirrup 70' rigidly connected to the block of the bending jacks, which block is rigidly connected to the inner wall of an upright of the holding cage. The roll body of the clamping jack is hinged on a support 71' rigidly connected to the lateral wall of the upright, the rod of the piston of the clamping jack Vc1 rigidly connected by means of a pivot link to the movable component 7. Controlling the limit stops of the movable component 7 also requires the use of electric contact limit stops (not shown).

Such a clamping system is appreciated in that it allows fast locking/unlocking of the axial movement of the chocks of the working rolls, namely the rolls that are most often removed from the rolling mill for rectification. Clamping systems of the same type are used to lock the chocks of the working rolls that nevertheless require less frequent maintenance than the working rolls.

The invention seeks to improve such automatic operation systems for clamping chocks of the working rolls, particularly in order to reduce costs.

The invention arises from the observation of the inventor that, in such Quarto rolling mills, the automatic clamping systems of the prior art use dedicated hydraulic jacks, associated with electric contact limit stops, to lock or unlock the axial movement of the chocks of the working rolls and the supporting rolls.

Furthermore, the invention arises from the desire of the inventor to design a system for clamping working rolls that requires neither dedicated jacks in order to operate nor dedicated electric limit stops.

Moreover, the invention relates to a rolling mill 1, particularly of the Quarto type, for a metal strip comprising a holding cage 2, comprising two pairs of uprights, at the two ends of the cage, between which an assembly of superimposed rolls is provided with substantially parallel axes, comprising two lower and upper working rolls 3, 4, defining the through-gap, and two respectively lower and upper supporting rolls 5, 6, intended to respectively come into abutment on the working rolls on the side opposite that of the through-gap.

Each working or supporting roll has two rotatably mounted ends, typically called journals, each being on a bearing borne by a chock 30, 40, 50, 60.

The rolling mill further comprises guiding means between the chocks 30, 40, 50, 60 of the rolls and the holding cage 2, along the clamping plane. These guiding means can comprise slide surfaces between the chocks and the frame (in particular the uprights) of the holding cage 2.

For Example:

- each chock 30 of the upper working roll 3 has two parallel and opposite slide plates 31, distributed on either side of the axis of rotation of the working roll 3, cooperating with two slide plates 27, respectively rigidly connected to the uprights of the same pair at one end of the holding cage;
- each chock 40 of the lower working roll 4 has two parallel and opposite slide plates 41, distributed on either side of the axis of rotation of the working roll 4, cooperating with the slide plates 27, respectively rigidly connected to the uprights of the same pair at one end of the holding cage.

For example, the two slide plates 27 are respectively rigidly connected to the inner walls of two blocks of the clamping jacks Vc3, Vc4, themselves respectively rigidly connected via their outer wall to the two inner walls of the uprights of the same pair of uprights of the cage.

Similarly:

- each chock 50 of the upper supporting roll 5 can have two parallel and opposite slide plates 51, distributed on either side of the axis of rotation of the supporting roll 5, cooperating with slide plates 25, rigidly connected to the uprights of the same pair at one end of the holding cage; and
- each chock 60 of the lower supporting roll 6 can have two parallel and opposite slide plates 61, distributed on either side of the axis of rotation of the supporting roll 6, cooperating with slide plates 26, rigidly connected to the uprights of the same pair at one end of the holding cage.

Figure 2:
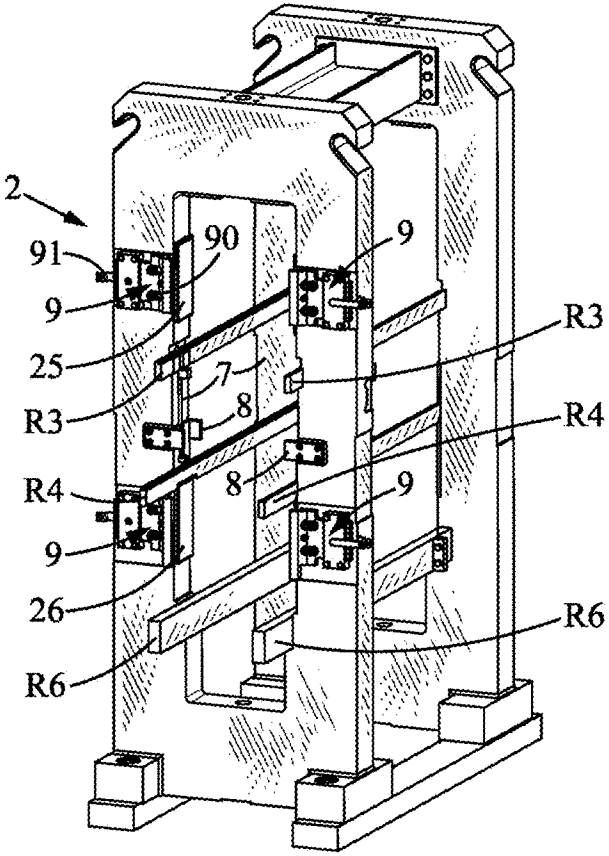
FIG. 2 is a perspective view of the holding cage of the rolling mill according to FIG. 1.
Figure 1:
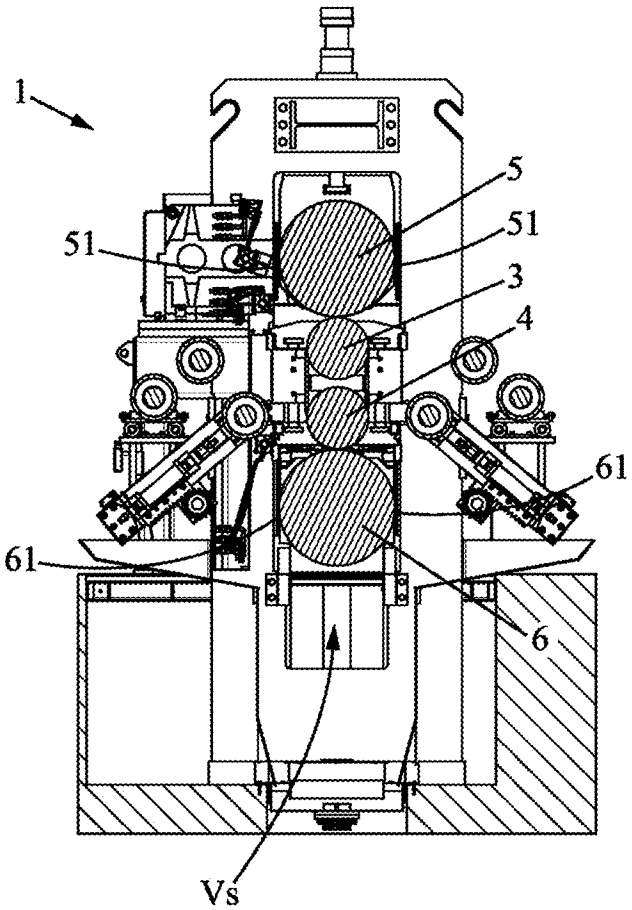
FIG. 1 is a view of a rolling mill of the Quarto type according to the invention, according to one embodiment of the invention, in a vertical section plane, perpendicular to the rolls.
Figure 3:
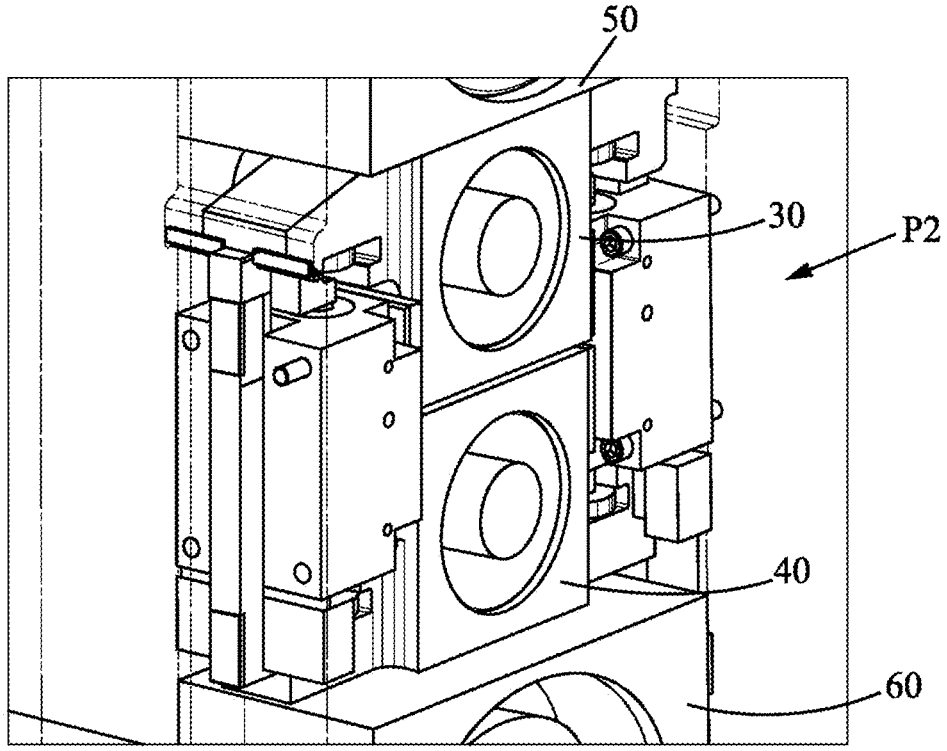
FIG. 3 is a detailed perspective view of two of the chocks respectively belonging to the upper working roll and to the lower working roll, in the closed position of the holding cage and in said locking position of said system for clamping chocks of the working rolls.

The rolling mill further comprises means for applying a clamping force between the chocks of the supporting rolls, typically comprising hydraulic jacks Vs. These hydraulic jacks Vs, of which there are two, can be disposed in the lower part of the holding cage and respectively come into abutment on the two chocks 60 of the lower supporting roll 6, as shown by way of an example in FIG. 1. According to one embodiment, not shown, these hydraulic jacks Vs also can be provided in the upper part of the holding cage 2 and respectively come into abutment on the chocks of the upper supporting roll.

The rolling mill further comprises a system for clamping chocks 30, 40 of the working rolls 3 and 5, even a system of clamping chocks 50, 60 of the supporting rolls 5, 6.

The invention nevertheless in this case more specifically relates to the system of clamping the working rolls, which is an automatic operation system, in that it involves the rolls of the rolling mill that are most often removed from the rolling mill for rectification. The system for clamping supporting rolls 5 and 6, which require less frequent maintenance, can be of the manual locking/unlocking type.

According to the invention, the system for clamping working rolls comprises mechanical means that can transition from a first retracted position P1, allowing withdrawal, along their axis, of the working rolls 3, 4 out of the holding cage 2, to a second locking position P2, enabling locking of the chocks 30, 40 in relation to the holding cage, along the axis of the roll.

Advantageously, and according to the invention, said mechanical means use:

- the approaching movement of the lower rolls 3, 4 in relation to the upper rolls 5, 6 when closing the holding cage in order to cause the transition from the first retracted position P1 to the second locking position P2; and
- the separating movement of the lower rolls 3, 4 in relation to the upper rolls 5, 6 during the opening of the holding cage in order to cause the transition from the second locking position P2 to the first retracted position P1.

The clamping of the chocks is thus caused by the closing of the holding cage 2, typically under the action of the deployment of the hydraulic jacks Vs, and the unclamping caused by the opening of the holding cage 2, typically under the action of the retraction of the hydraulic jacks Vs. In other words, the clamping and unclamping operations use the hydraulic jacks of said means for applying a clamping force between the chocks of the supporting rolls, advantageously without requiring an actuator dedicated to these operations.

According to one embodiment, said mechanical means comprise at least one movable component 7 sliding along an upright of the holding cage 2 under the action of the opening or closing movements of the holding cage 2. The movable component 7 extends lengthwise, along an upright of the holding cage 2, for example, received in a deep groove of the inner wall of an upright, the movable component 7 being capable of sliding along a limited stroke in this groove.

This movable component 7 comprises a locking end 71, which, in said second locking position P2 of the mechanical means, simultaneously enters a vertical groove 32 of one of the chocks 30 of a working roll 3 and a vertical groove 28 rigidly connected to the upright of the holding cage 2; the locking end 71 simultaneously received in these two facing grooves 28, 32 thus provides the locking of the chock in relation to the holding cage 2, along the axis of the working roll. In the first retracted position P1 of the mechanical means, the locking end 71 is retracted out of the groove 32 of the chock 30, thus releasing the axial movement of the roll and so as to allow the withdrawal of the roll out of the holding cage.

The movable component 7 can have, at its other longitudinal end, a part 72 for coupling to the chock 40 of the working roll 4 located on the other side of the unwinding plane of the metal strip, called upper or lower drive chock, and cooperating with a complementary coupling part of the drive chock. This coupling of the movable component 7 allows the vertical movement of the movable component 7 to be synchronized with the drive chock during opening or closing movements of the holding cage 2.

Figure 4:
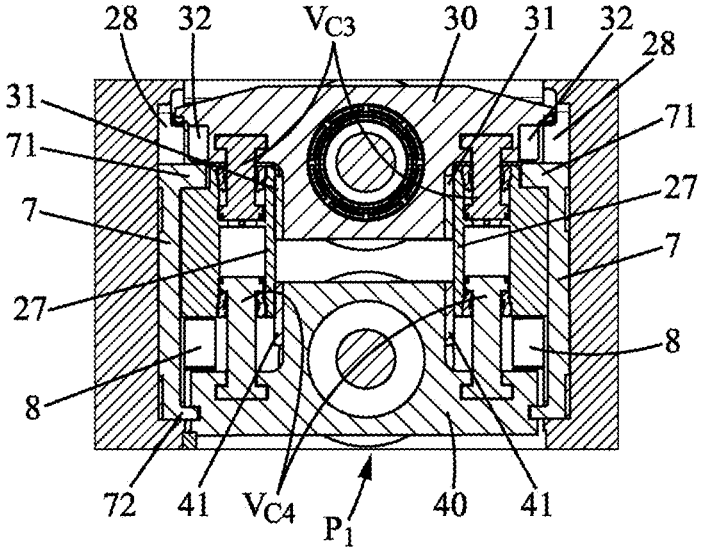
FIGS. 4 and 5 respectively show two views of said mechanical means of the clamping system, respectively in said first retracted position and in said second locking position.

FIG. 4 shows, by way of a non-limiting example, the presence of two movable components 7, respectively mounted to internally slide along the two uprights of the holding cage. These two movable components 7 are, in their first retracted position P1, at the lower end-of-stroke position in said open position of the holding cage for which the chock 30 of the upper working roll is separated from the chock 40 of the lower working roll, the upper chock 30 resting, via two projecting lateral parts of the chock, on two support rails R3 of the holding cage, the lower chock 40 resting, via two projecting lateral parts of the chock, on two other support rails R4 of the holding cage.

For each movable component 7 (left-hand or right-hand), the locking end 71, in the upper part of the movable component 7, is disengaged out of the groove 32 (left-hand or right-hand) of the chock 30 of the upper working roll 3. In this position, the upper working roll 3 and its chocks 30 can be removed from the rolling mill, by sliding the chocks 30 along the support rails R3, particularly by means of a system of extraction and of carriages per se known to a person skilled in the art.

For each movable component 7, the coupling part 72 of the movable component 7, at its lower end, is secured to the chock 40 of the lower working roll 4 in a detachable manner. In this position, the lower working roll 4 and its chocks 40 can be removed from the rolling mill, by sliding the chocks 40 along the support rails R4 by means of a system of extraction and of carriages per se known to a person skilled in the art.

The coupling part 72 of the movable component 7 and the complementary coupling part of the drive chock thus can comprise a groove/rib system respectively belonging to the chock 40 and to the movable component 7, or vice versa. This coupling part 72 of the movable component is positioned, at the end-of-stroke position, in said open position of the holding cage, in a position in relation to the support rails R4, so as to allow the coupling/decoupling of the lower end of the movable component to/from the drive chock during the loading/unloading of the working roll along the support rails.

Thus, and according to the embodiment of FIG. 4, the drive chocks are the chocks 40 of the lower working roll 4, the movable component 7 being positioned, in said open position of the holding cage 2, at the lower end-of-stroke position under the effect of gravity in a position in relation to the support rails R4, so as to allow the coupling/decoupling of the lower end of the movable component 7 to/from the drive chock during the loading/unloading of the working roll along the support rails R4.

The automatic clamping operation will be described hereafter from the open position of the holding cage shown in the figures. When the holding cage 2 is closed under the action of the hydraulic jacks Vs, the lower supporting roll 6 lifts, until it brings the lower working roll 4 therewith, the chocks 40 of which rest on the support rails R4. Each chock 40 of the lower working roll 4 then lifts off the support rails R4 and then simultaneously drives the right-hand and left-hand movable components 7, in the upwards direction and until the movable components 7 lock the axial position of the chock of the upper working roll 3, by simultaneously inserting each of the locking ends 71 in the corresponding opposite grooves 28 and 31, respectively belonging to the frame and to the chock 30 of the upper working roll 3.

Said mechanical means of the clamping system thus comprise, for clamping/unclamping the chocks 30 of the upper working roll 3, one or preferably more movable component(s) 7, the locking ends 71 of which enable the locking of the chocks of said working roll.

Said mechanical means of the clamping system can further comprise, for clamping/unclamping the chocks 40 of the other lower working roll 4, projecting parts 8 rigidly connected to the uprights of the holding cage and the lateral parts 42 of the chock 40, which, in said second locking position P2 of the mechanical means, in the closed position of the holding cage, overlap so as to prevent the axial movement of the working roll 4. In said first retracted position P1, these parts 8 and 42 are disengaged (one above the other) and so as to release the axial movement of the working roll 4, in the open position of the holding cage.

Thus, FIG. 4 shows said projecting parts 8, which extend from the uprights toward the inside of the window. These projecting parts 8 are located above the two projecting lateral parts 42 of the chock 40 of the lower working chock 4, in said open position of the holding cage.

Figure 5:
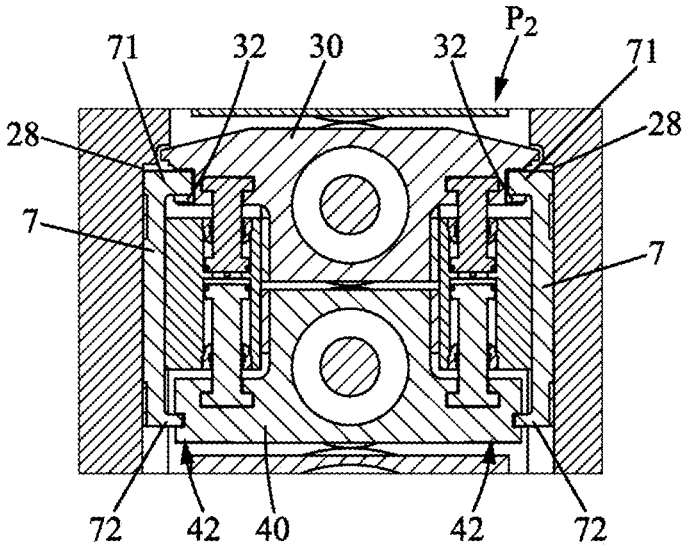

When closing the holding cage 2, the upwards movement of the lower working roll enables the positioning of the two projecting parts 8 by overlapping with said lateral parts 42 of the chock 40 of the lower working roll 4, and as shown in FIG. 5. The possibility of moving the lower working roll 4, along the axis of the roll, is prevented, the projecting parts 8 forming physical stops for the chock 40, along the axis of the lower working roll 4. There can be two projecting parts 8 per upright, one locking the chock in a first direction, the other locking the chock in the opposite direction.

It is to be noted that the embodiment shown is a rolling mill having hydraulic jacks Vs (said means for applying a clamping force between the chocks of the supporting rolls) that are located at the lower end of the holding cage.

In the case (not shown) that these hydraulic jacks are located at the upper end of the holding cage 2, the configuration of the mechanical means is reversed, and particularly:

- for clamping the lower working roll, the locking end of the movable component 7 then clamps/unclamps the chock of the lower working roll, the coupling part of the movable component then being synchronized with the vertical movements of the chock of the upper working roll;
- the drive chocks are then the chocks of the upper working roll, the movable component being able to be positioned in said open position of the holding cage, under the effect of a resilient means, against gravity, at the upper end-of-stroke position in a position in relation to the support rails, so as to allow the coupling/decoupling of the lower end of the movable component to/from the drive chock during the loading/unloading of the upper working rail along the support rails;

for clamping the chocks of the other upper working roll, the projecting parts that are rigidly connected to the uprights of the holding cage and the corresponding lateral parts of the chocks of the upper working roll can be used, which, in said second locking position of the mechanical means, in the closed position of the holding cage, are overlapping so as to prevent the axial movement of the upper roll and which, in said first retracted position, are disengaged in the open position of the holding cage, so as to release the axial movement of the upper roll.

According to one embodiment, the rolling mill comprises means for applying vertical bending forces on the working rolls 3, 4, comprising two assemblies of hydraulic jacks Vc3, Vc4, which can be double-acting jacks, and each having a fastening end intended to be fitted into a complementary groove of the chock of a working roll. Each chock 30 or 40 comprises two fastening grooves, disposed either side of the axis of the roll 6 or 4, parallel to the axis of the roll, and machined in the vicinity of two projecting lateral parts of the chock.

As shown by way of a non-limiting example, the fastening end not only allows the jack Vc3 or Vc4 to exert a thrust force on the chock 30 or 40, but also a traction force by virtue of the shape of the complementary groove that prevents the withdrawal of the wide end of the rod of the jack through the groove inlet.

For each side of the window, the cylinder of the piston of the hydraulic jack Vc3 for bending the upper chock 30 and the cylinder of the piston of the hydraulic jack Vc4 for bending the lower chock 40 can be machined from the same block. One of the walls of the block is laterally fastened to an inner wall of an upright and the other wall can be the support for the slide plate 27 intended for the vertical guidance of the upper chock 30 and the lower chock 40.

The groove into which the movable component 7 slides can be provided, in an over depth of the upright, between the upright and this block, the locking end 71 and the coupling part 72 at the other distal end of the movable component 7 being respectively located above and below this block.

According to one embodiment, the rolling mill comprises a system 9 for clamping chocks of the supporting rolls, capable of transitioning from a retracted state, allowing withdrawal, along their axis, of the supporting rolls out of the holding cage, to a locking state, enabling locking of the chocks in relation to the cage, along the axis of the roll, while allowing the chocks to slide along the guiding means, along the clamping plane.

This clamping system 9 can comprise vertical grooves for the chocks 50, 60 of the upper supporting chock 5 and of the lower supporting chock 6, as well as locking components 90, mounted to slide horizontally. Each locking component can transition from a position in which it enters the vertical groove of the chocks 50 or 60, preventing the axial movement of the supporting roll, to a retracted position, in which the axial movement is released. Given the maintenance frequency of the supporting rolls, the clamping system can be manual, with the transition from the retracted position to the locking position being manual and being obtained by activating a handle 91.

Of course, other embodiments could be contemplated by a person skilled in the art without necessarily departing from the scope of the invention as defined by the following claims.

NOMENCLATURE

Invention

1. Rolling mill.
2. Holding cage.
3, 4. Working rolls.
5, 6. Supporting rolls.
30, 40. Chocks of the working rolls.
50,60. Chocks of the supporting rolls.
25, 26, 27. Slide plates (frame).
28, 32. Vertical grooves (upright and working roll chock).
31, 41, 51, 61. Slide plates (chocks).
7. Movable component (system for clamping working rolls).
71. Locking end.
8. Projecting parts.
42. Lateral parts (chocks).
9. System for clamping supporting rolls.
91. Handle.
R3, R4, R6. Support rail. Upper working roll, upper working roll and lower supporting roll.
Vs. Hydraulic jacks (means for applying a clamping force between the chocks of the supporting rolls).
Vc3, Vc4. Bending jacks.

PRIOR ART

1'. Rolling mill.
2'. Holding cage.
70', 71'. Stirrup and support.

The invention claimed is:

1. A rolling mill (1) for a metal strip comprising:

a holding cage (2) comprising first and second uprights at two ends of the holding cage, each of the first and second uprights including an inside wall with a vertical groove (28);

an assembly of superimposed rolls with substantially parallel axes, the assembly comprising a lower supporting roll (5), an upper supporting roll (6), a lower working roll (4), and an upper working roll (3), wherein, the lower working roll is adjacent the upper working roll, a through-gap being defined between the lower working roll and the upper working roll, the lower working roll and the upper working roll are located between the lower supporting roll and the upper supporting roll, the upper working roll is in abutment with the upper supporting roll, the lower working roll is in abutment with the lower supporting roll;

bearings borne by chocks (30, 40, 50, 60), the chocks being movable along a direction parallel to a clamping plane, one of the bearings borne by a respective one of the chocks (30, 40, 50, 60) mounting each end of the lower supporting roll (6), the upper supporting roll (5), the lower working roll (4), and the upper working roll (3), a first set of the chocks (30, 40) supporting the upper and lower working rolls (3, 4), one of the chocks (30) of the first set of chocks (30, 40) having a vertical groove (32);

plural guides, each guide located between a respective one of the chocks (30, 40, 50, 60) and the holding cage (2), the guides located along the clamping plane, the chocks slideable along the clamping plane;

a clamp comprising a pair of hydraulic jacks (Vs), a first of the hydraulic jacks in abutment on a first of the chocks supporting the lower supporting roll (6) and a second of the hydraulic jacks in abutment on a second of the chocks supporting the lower supporting roll (6), the hydraulic jacks operative to apply a clamping force between the first and second chocks;

a clamping system locking the first set of chocks (30, 40) supporting the upper and lower working rolls (3, 4) in relation to the holding cage, along a respective axis of each of the upper and lower working rolls (3, 4), while allowing the first set of chocks (30, 40) to slide along the guides, along the clamping plane, the clamping system comprising a movable component (7) received in the groove (28) of the inner wall of one of the first and second uprights of the holding cage (2) and extending lengthwise along the one upright of the holding cage (2) in the groove (28) of the inner wall of the one upright, under action of opening and closing movements of the holding cage (2), the movable component (7) slideable along the one upright of the holding cage (2) between i) a first retracted position (P1) in which the upper and lower working rolls are out of the holding cage (2) and ii) a second locking position (P2) in which the first set of the chocks (30, 40) supporting the upper and lower working rolls (3, 4) are locked in relation to the holding cage, the movable component (7) comprising a locking end (71), wherein, the movable component (7) is operative to transit from the first retracted position (P1) along the axes of the upper and lower working rolls, to the second locking position (P2), locking the first set of chocks (30, 40) to the holding cage, when closing the holding cage, an approaching movement of the upper and lower working rolls (3, 4) in relation to the and lower supporting rolls (5, 6) causes a transition from the first retracted position (P1) to the second locking position (P2); and during opening of the holding cage, a separating movement of the upper and lower working rolls (3, 4) in relation to the upper and lower supporting rolls (5, 6) causes a transition from the second locking position (P2) to the first retracted position (P1), the locking end (71), in moving into said second locking position (P2), simultaneously enters and is received in the vertical groove (32) of the one of the chocks (30) the first set of chocks (30, 40) and the vertical groove (28) of the upright of the holding cage (2) to lock the first set of the (30, 40) to the holding cage, and the locking end (71), in moving into the first retracted position (P1) is retracted to slide out of the vertical groove (32) of the of the one of the chocks (30) the first set of chocks (30, 40) thereby allowing withdrawal of the upper and lower working rolls (3, 4) out of the holding cage.

2. The rolling mill as claimed in claim 1, wherein, in said first retracted position (P1), said movable component (7) is held in the vertical groove (28) of the upright of the holding cage (2).

3. The rolling mill as claimed in claim 1, wherein, the chock (40) of the lower working roll (4) comprises drive chocks (40), and the movable component (7) has, at an end opposite the locking end (71), a coupling part (72) that couples to one of the drive chocks (40) of the lower working roll (4) so as to allow the movement of the movable component (7) to be synchronized with the one drive chock during the opening and closing movements of the holding cage (2).

4. The rolling mill as claimed in claim 3, further comprising support rails (R4) extending parallel between the first and second uprights at the two ends of the holding cage (2), wherein, in said in said first retracted position (P1), the drive chocks (40) rest on the support rails (R4), the coupling part (72) and the one drive chock comprising a groove/rib system, the coupling part (72) being positioned, at an end-of-stroke position, in said first retracted position (P1), in a position in relation to the support rails, so as to allow coupling/decoupling of the coupling part (72) to/from the drive chock during the loading/unloading of the upper and lower working rolls along the support rails.

5. The rolling mill as claimed in claim 4, wherein, with the movable component (7) being positioned, in said first retracted position (P1), at the lower end-of-stroke position under an effect of gravity in a position in relation to the support rails (R4), allows coupling/decoupling of a lower end of the movable component (7) to/from the drive chock during the loading/unloading of the lower working roll along the support rails.

6. The rolling mill as claimed in claim 1, further comprising support rails (R4) extending parallel between the first and second uprights at the two ends of the holding cage (2), wherein, the chock (40) of the upper working roll (3) comprises drive chocks (40), and the movable component (7) has, at an end opposite the locking end (71), a coupling part (72) that couples to one of the drive chocks (40) of the upper working roll (3) so as to allow the movement of the movable component (7) to be synchronized with the one drive chock during the opening and closing movements of the holding cage (2), in said in said first retracted position (P1), the drive chocks (40) rest on the support rails (R4), the coupling part (72) and the one drive chock comprising a groove/rib system, the coupling part (72) being positioned, at an end-of-stroke position, in said first retracted position (P1), in a position in relation to the support rails, so as to allow coupling/decoupling of the coupling part (72) to/from the drive chock during the loading/unloading of the upper and lower working rolls along the support rails, and with the movable component (7) being positioned in said first retracted position (P1), at the upper end-of-stroke position, in a position in relation to the support rails, allows coupling/decoupling of an upper end of the movable component to/from the drive chock during the loading/unloading of the upper working roll along the support rails.

7. The rolling mill as claimed in claim 1, comprising plural of said movable component (7), wherein, the chocks (30) of the upper working roll (3) includes one or more of said movable component (7), the locking ends (71) of said one of more movable component (7) enable locking of the chocks of said upper working roll;

the chocks (40) of the lower working roll comprises projecting parts (8), rigidly connected to the first and second uprights of the holding cage, and corresponding lateral parts (42) of the chocks (40), which, in said second locking position (P2), are overlapping so as to prevent axial movement of the lower working roll (4), and which, in said first retracted position (P1), are disengaged so as to release the axial movement of the lower working roll (4).

8. The rolling mill as claimed in claim 1, further comprising two assemblies of hydraulic jacks (Vc3, Vc4) fitting to the upper and lower working rolls (3, 4) and operative to apply vertical bending forces on the working rolls (3, 4).

9. The rolling mill as claimed in claim 8, wherein the hydraulic jacks (Vc3, Vc4) are double-acting jacks, each hydraulic jack having a fastening end fitted into a complementary groove of the chock of one of the upper and lower working rolls.

10. The rolling mill as claimed in claim 1, the clamping system further comprising a handle (91), activation of the handle (91) allowing manual transitioning of the upper and lower supporting rolls (5, 6) from a retracted state, allowing withdrawal of the upper and lower supporting rolls out of the holding cage, to a locking state, enabling locking of the chocks (50, 60) of the upper and lower supporting rolls (5, 6) in relation to the holding cage, along an axis of each of the upper and lower supporting roll, while allowing the chocks (50, 60) of the upper and lower supporting rolls (5, 6) to slide along the guides, along the clamping plane.

11. The rolling mill as claimed in claim 2, wherein, the chock of one of the lower and upper working rolls comprises drive chocks, and the movable component (7) has, at an end opposite the locking end (71), a coupling part (72) that couples to one of the drive chocks so as to allow the movement of the movable component (7) to be synchronized with the one drive chock during the opening and closing movements of the holding cage (2).

12. The rolling mill as claimed in claim 2, comprising plural of said movable component (7), wherein, the chocks (30) of the upper working roll (3) includes one or more of said movable component (7), the locking ends (71) of said one of more movable component (7) enable locking of the chocks of said upper working roll;

the chocks (40) of the lower working roll comprises projecting parts (8), rigidly connected to the first and second uprights of the holding cage, and corresponding lateral parts (42) of the chocks (40), which, in said second locking position (P2), are overlapping so as to prevent axial movement of the lower working roll (4), and which, in said first retracted position (P1), are disengaged so as to release the axial movement of the lower working roll (4).

13. The rolling mill as claimed in claim 3, comprising plural of said movable component (7), wherein, the chocks (30) of the upper working roll (3) includes one or more of said movable component (7), the locking ends (71) of said one of more movable component (7) enable locking of the chocks of said upper working roll;

the chocks (40) of the lower working roll comprises projecting parts (8), rigidly connected to the first and second uprights of the holding cage, and corresponding lateral parts (42) of the chocks (40), which, in said second locking position (P2), are overlapping so as to prevent axial movement of the lower working roll (4), and which, in said first retracted position (P1), are disengaged so as to release the axial movement of the lower working roll (4).

14. The rolling mill as claimed in claim 4, comprising plural of said movable component (7), wherein, the chocks (30) of the upper working roll (3) includes one or more of said movable component (7), the locking ends (71) of said one of more movable component (7) enable locking of the chocks of said upper working roll;

the chocks (40) of the lower working roll comprises projecting parts (8), rigidly connected to the first and second uprights of the holding cage, and corresponding lateral parts (42) of the chocks (40), which, in said second locking position (P2), are overlapping so as to prevent axial movement of the lower working roll (4), and which, in said first retracted position (P1), are disengaged so as to release the axial movement of the lower working roll (4).

15. The rolling mill as claimed in claim 5, comprising plural of said movable component (7), wherein, the chocks (30) of the upper working roll (3) includes one or more of said movable component (7), the locking ends (71) of said one of more movable component (7) enable locking of the chocks of said upper working roll;

the chocks (40) of the lower working roll comprises projecting parts (8), rigidly connected to the first and second uprights of the holding cage, and corresponding lateral parts (42) of the chocks (40), which, in said second locking position (P2), are overlapping so as to prevent axial movement of the lower working roll (4), and which, in said first retracted position (P1), are disengaged so as to release the axial movement of the lower working roll (4).

16. The rolling mill as claimed in claim 1, comprising plural of said movable component (7), wherein, the chocks of the lower working roll includes one or more of said movable component (7), the locking ends (71) of said one of more movable component (7) enable locking of the chocks of said lower working roll;

the chocks of the upper working roll comprises projecting parts (8), rigidly connected to the first and second uprights of the holding cage, and corresponding lateral parts of the chocks, which, in said second locking position (P2), are overlapping so as to prevent axial movement of the upper working roll, and which, in said first retracted position (P1), are disengaged so as to release the axial movement of the upper working roll (3).

17. The rolling mill as claimed in claim 2, further comprising two assemblies of hydraulic jacks (Vc3, Vc4) fitting to the upper and lower working rolls (3, 4) and operative to apply vertical bending forces on the working rolls (3, 4).

18. The rolling mill as claimed in claim 3, further comprising two assemblies of hydraulic jacks (Vc3, Vc4) fitting to the upper and lower working rolls (3, 4) and operative to apply vertical bending forces on the working rolls (3, 4).

19. The rolling mill as claimed in claim 4, further comprising two assemblies of hydraulic jacks (Vc3, Vc4) fitting to the upper and lower working rolls (3, 4) and operative to apply vertical bending forces on the working rolls (3, 4).

20. The rolling mill as claimed in claim 1, comprising plural of said movable component (7), wherein, the chocks (40) of the lower working roll (4) includes one or more of said movable component (7), the locking ends (71) of said one or more of movable component (7) enable locking of the chocks of said lower working roll;

the chocks (30) of the upper working roll comprises projecting parts (8), rigidly connected to the first and second uprights of the holding cage, and corresponding lateral parts of the chocks (30), which, in said second locking position (P2), are overlapping so as to prevent axial movement of the upper working roll (3), and which, in said first retracted position (P1), are disengaged so as to release the axial movement of the upper working roll (3).

* * * * *